US005296852A

United States Patent [19]

Rathi

[11] Patent Number: 5,296,852

[45] Date of Patent: Mar. 22, 1994

[54] METHOD AND APPARATUS FOR MONITORING TRAFFIC FLOW

[76] Inventor: Rajendra P. Rathi, 21008 Green Hill Rd., Farmington Hills, Mich. 48335

[21] Appl. No.: 661,297

[22] Filed: Feb. 27, 1991

[51] Int. Cl.[5] ..... G08G 1/01

[52] U.S. Cl. ..... 340/933; 340/934; 340/937; 340/939; 364/436; 348/149

[58] Field of Search ..... 340/933, 934, 937, 939; 358/105, 108; 364/436

[56] References Cited

U.S. PATENT DOCUMENTS

| | | | |
|---|---|---|---|
| 4,214,265 | 7/1980 | Olesen | 340/937 |
| 4,433,325 | 2/1984 | Tanaka et al. | 340/937 |
| 4,490,851 | 12/1984 | Gerhart et al. | 382/43 |
| 4,709,264 | 11/1987 | Tamura et al. | 358/93 |
| 4,839,648 | 6/1989 | Beucher et al. | 340/937 |
| 4,847,772 | 7/1989 | Michalopoulos et al. | 364/436 |

FOREIGN PATENT DOCUMENTS

| | | | |
|---|---|---|---|
| 0403193 | 12/1990 | European Pat. Off. | 340/937 |
| 1015413 | 4/1983 | U.S.S.R. | 340/933 |

OTHER PUBLICATIONS

1985 IEEE, Traffic Monitoring and Control Using Machine Vision A Survey by Rafael M. Inigo pp. 177-185.

"Development of a Breadboard System For Wide Area Vehicle Detection" by Panos G. Michalopoulus, Robert Fitch and Blake Wolf, Proceedings of the Forty-Second Annual Ohio Transportation Engineering Conference, Nov. 29-30, 1988, Columbus, Ohio.

*Primary Examiner*—John K. Peng
*Assistant Examiner*—Nina Tong
*Attorney, Agent, or Firm*—James M. Stover

[57] ABSTRACT

A vision processing apparatus and method for detecting and monitoring traffic flow. The method includes the steps of generating successive images of a section of roadway; transducing the successive images into successive arrays of pixels, each pixel having a luminance value associated therewith; summing the luminance values of all pixels contained within a subarray, or "window" in each one of the arrays; comparing the pixel luminance sum for each one of the subarrays to a reference value; and generating data indicative of the presence of traffic in the section of the path when the difference between the pixel luminance sum and the reference value exceeds a predetermined value. The generated data can thereafter be analyzed to determine various traffic and vehicle parameters, or can be used to operate traffic control devices.

9 Claims, 7 Drawing Sheets

NUMBER OF PIXELS
100
80
60
40
20
L1
H1
0
20
40
60
80
100
120
140
160
M1
LUMINANCE

NUMBER OF PIXELS
50
40
30
20
10
L2
H2
0
20
40
60
80
100
120
140
160
180
200
240
M2
LUMINANCE

METHOD AND APPARATUS FOR MONITORING TRAFFIC FLOW

The present invention relates in general to systems for monitoring traffic flow and, more particularly, to an automated vision device for collecting and analyzing highway traffic flow data.

BACKGROUND OF THE INVENTION

The management of an efficient and safe highway transportation system requires the collection and analysis of various data concerning the flow of vehicles on the streets and roadways which comprise the highway system. Local, state and national transportation planners utilize this collected data as a basis for future construction of new facilities, the installation of traffic control equipment or improvement of the existing highway system. Additionally, the collected and analyzed traffic information can provide valuable assistance to developers in the planning of housing, retail, and industrial construction.

In addition to being used to collect traffic data for monitoring and planning purposes, traffic sensing devices are also utilized in conjunction with traffic signals and other traffic control devices for the real-time control of traffic.

The conventional method for collecting traffic data involves the use of one or more pneumatic tubes placed across the roadway pavement. Vehicles crossing the tube actuate an impulse switch that operates a counting mechanism. For permanent installations, loop detectors embedded in the roadway are commonly used. A typical loop detector consists of a wire loop placed in the pavement to sense the presence of vehicles through magnetic induction. The ends of the loop are connected to an electronic amplifier usually located at a roadside controller.

Although transportation agencies have been using pneumatic tubes and loop detectors for many years, there remain many problems with these devices. For example, pneumatic tubes are susceptible to damage from braking wheels, roadway conditions, age and lack of proper upkeep. In addition recording errors can be introduced by multi-axle vehicles, improper placement of the tubes, movement of the tubes or by a vehicle parked with a wheel in contact with the tube.

Though loop detectors have been found to perform better than pneumatic tubes, they are impractical for temporary purposes, are more expensive to install, and are difficult to repair or replace. Usually several loops or pneumatic tubes are required to obtain information regarding vehicle speeds, the spacing of vehicles or the identification of types of vehicles, such as trucks, busses, cars, etc. Furthermore, neither loop detectors nor pneumatic tubes is suitable for measuring lateral placement of vehicles in travelled lanes. A knowledge of vehicle lateral placement is important when, for example, the safety effects of lane control devices such as barriers, guardrails, signs, pavement markings, drums, and cones are evaluated. In addition, vehicle lateral placement can be analyzed to evaluate drivers perceptions and reactions to road signs, or to determine if a motorist is driving under the influence of alcohol.

OBJECTS OF THE INVENTION

It is a primary object of the present invention to provide a new and useful method and apparatus for monitoring traffic flow.

It is a further object of the present invention to provide such an apparatus which utilizes a vision system to monitor traffic flow.

It is an additional object of the present invention to provide a method and apparatus for evaluating a video signal to extract traffic flow information therefrom.

It is also an object of the present invention to provide such a method and apparatus wherein different portions of the video signal corresponding to different sections of a roadway being monitored can be selected for analysis.

It is a still further object of the present invention to provide a portable, non-contacting means for collecting traffic information.

It is an also object of the present invention to provide such a portable, non-contacting means wherein collected traffic information is utilized in traffic monitoring.

A still further object of the present invention is to provide a new and useful means for collecting traffic information for use in determining vehicle spacing, classifying vehicles by type, or determining vehicle speed.

It is another object of the present invention to provide a new and useful procedure and means for controlling traffic flow.

It is another object of the present invention to provide such a procedure and means for controlling traffic signal devices, such as stop lights at an intersection.

SUMMARY OF THE INVENTION

In accordance with the principals of the present invention, there is provided a vision processing apparatus and method for detecting traffic flow along a predetermined path. The method comprising the steps of generating successive images of a section of said path; transducing the successive images into successive arrays of pixels, each pixel having a luminance value associated therewith; summing the luminance values of all pixels in each one of the arrays; comparing the pixel luminance sum for each one of the successive arrays to a reference value; and generating data indicative of the presence of traffic in the section of the path when the difference between the pixel luminance sum and the reference value exceeds a predetermined value.

In accordance with the preferred method, described below, digitized information corresponding to a small section, or "window", along the vehicle path in each successive image is isolated by the vision processor system for evaluation. The reference value is determined by summing together the pixel luminance values contained in the window of a first "background" frame. The pixel luminance values for the window associated with the video frame following the background frame are summed together and compared to the reference value to determine the presence of a vehicle in the window.

Alternative methods for analyzing and comparing the video images contained within the windows, and methods for determining spacing between vehicles along a roadway, vehicle speed and vehicle size are also presented.

The foregoing and other objects of the present invention together with the features and advantages thereof will become apparent from the following detailed specification when read in conjunction with the accompanying figures.

BRIEF DESCRIPTION OF THE INVENTION

DETAILED DESCRIPTION OF THE INVENTION

Figure 1:
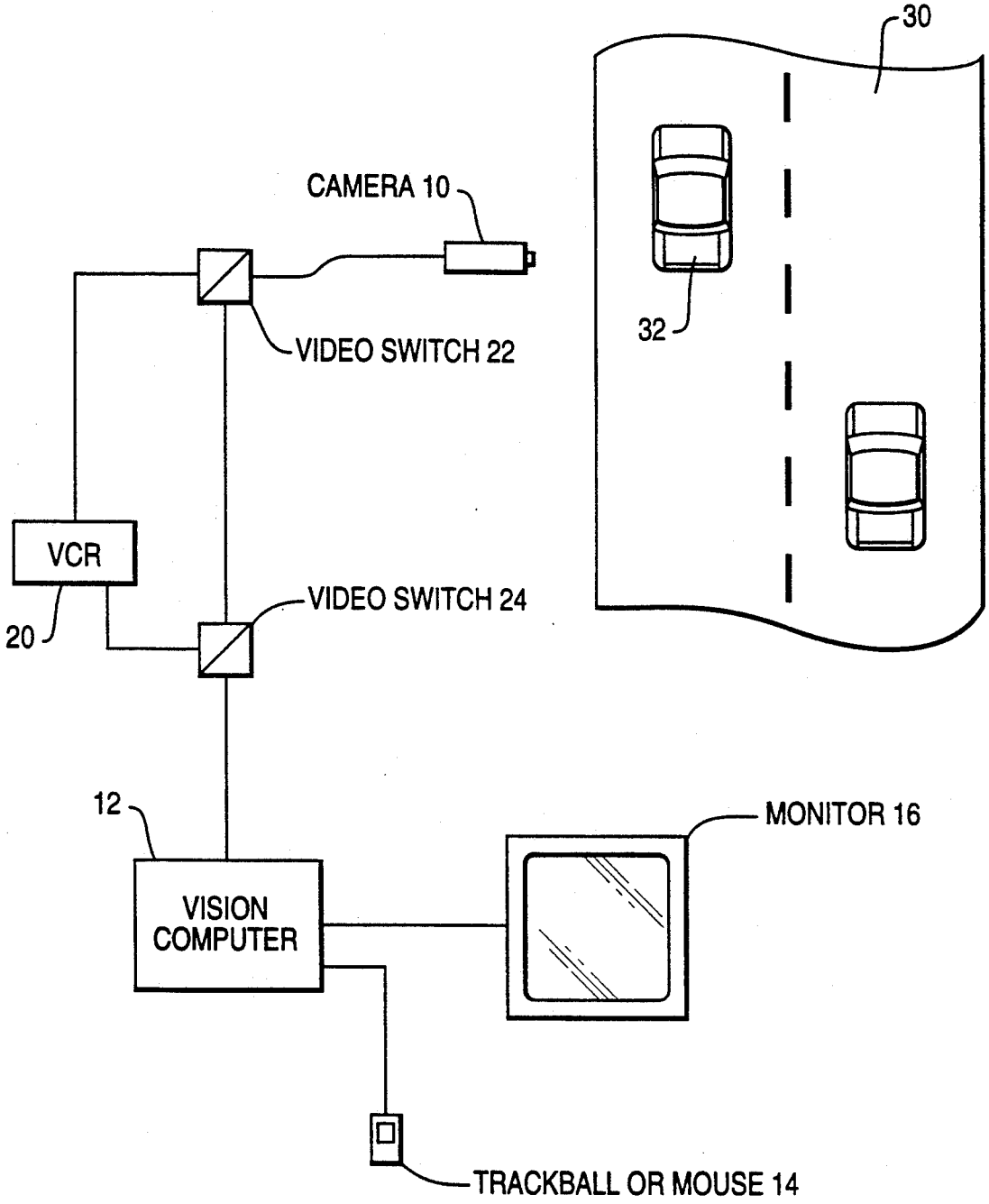
FIG. 1 is a block diagram representation of a video system for monitoring traffic flow in accordance with the present invention.

Referring now to the block diagram of FIG. 1, the traffic monitoring system is seen to include a conventional video camera 10 positioned to view the traffic traveling along a segment of a roadway 30. The output of camera 10, a standard RS-170 signal, is provided to a vision computer 12 which digitizes and processes the received information to generate an output data signal indicative of traffic flow through the viewed section of roadway 30. The output of vision processor 12 is optionally provided to a video monitor 16. Also shown in FIG. 1 is a video cassette recorder 20 that can be connected to camera 10 via video switch 22 for recording the video signal output of the camera for later processing.

The vision computer can be configured through the use of video switch 24 to receive its input from the VCR output in the case of a pre-recorded signal or directly from the camera, as described above, for real time analysis. Vision computer 12 may include a commercially available vision processor such as the SUPRAVISION SPV512 Satellite Vision Processor manufactured by International Robomation Intelligence.

Figure 2:
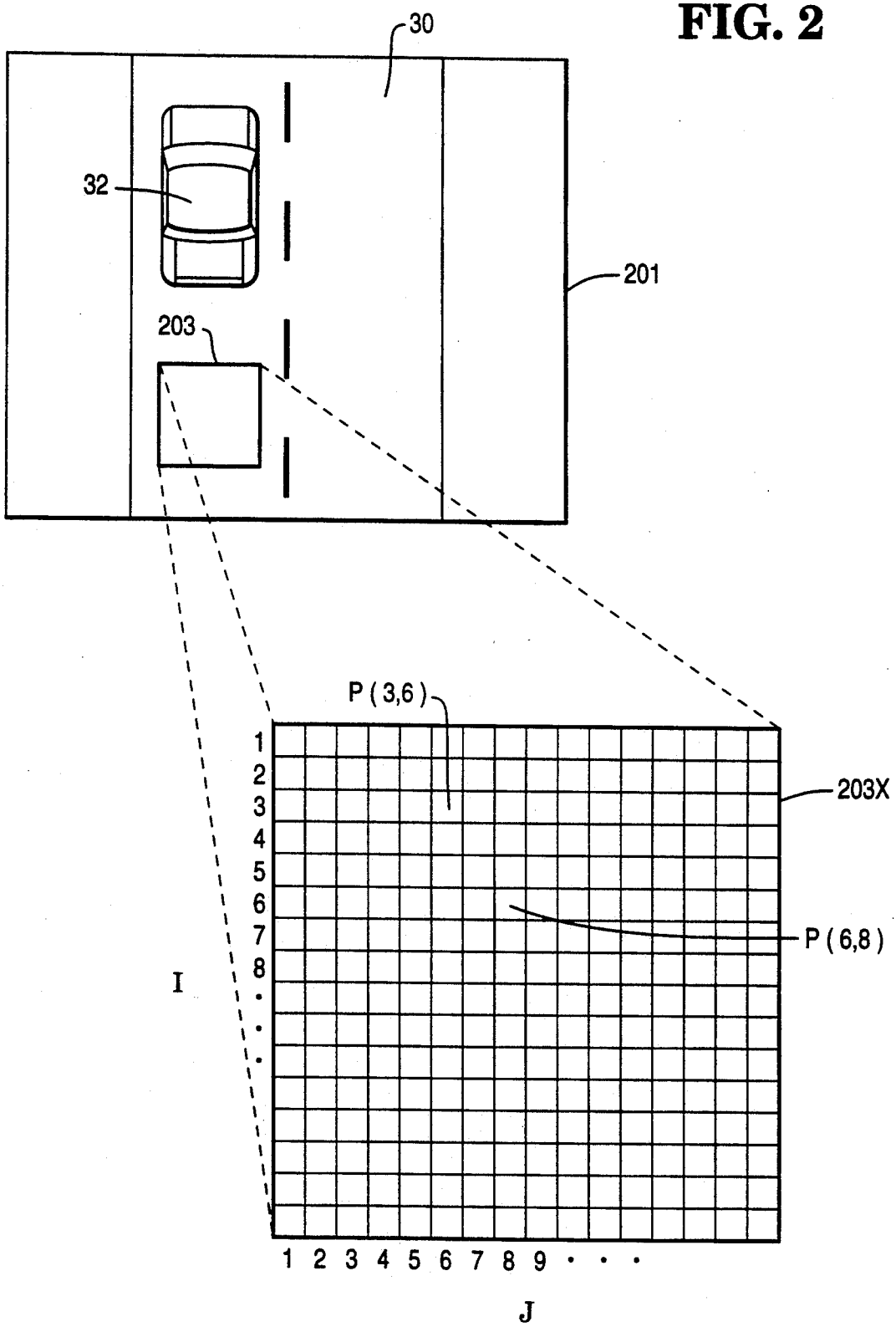
FIG. 2 is an illustration of a first video frame captured by the camera shown in FIG. 1 including a closeup of a rectangular window which is analyzed by the video system to determine the presence of a vehicle.

The real time video signal provided by camera 10 or the pre-recorded video signal provided by video recorder 20 is processed by vision computer 12 as now explained with reference to FIGS. 2 and 3. FIG. 2 is an illustration of a first video frame 201 captured by camera 10 shown in FIG. 1. Shown in frame 201 is the roadway 30 and a vehicle 32 traveling along the roadway. The video signal is a standard RS-170 analog signal formed by scanning the entire field of view of camera 10 horizontally from left to right and vertically top to bottom in a raster pattern at a standard video rate. Up to thirty frames are scanned every second.

Vision processor 12 converts the analog video signal into digital pixel data, resolving each horizontal scan line into 256 segments. Thus, every frame is sampled into a 256×256 grid, wherein each of the 65,536 grid elements is referred to as a picture element or "pixel". Video processor 12 assigns grey level luminance values ranging from 0 to 255, with 0 being black and 255 being white, to each picture element of frame 201.

It should be noted, however, that a camera or video equipment having a resolution other than 256×256 may be employed in the present system. For example, equipment may be provided for resolving each video frame into a 512×512 pixel grid containing 262,144 grid elements. Similarly, the video processor may determine luminance values having a range of values other than 0 through 256.

At this point in the operation of the system one or more of the following image processing techniques may be employed to remove noise and improve contrast between objects appearing in the camera's field of view and the background: low pass convolution filtering, opening and closing morphological filtering, minimum and maximum filtering, background subtraction and image enhancement using histogram equalization.

The video processor is programmed to select and store the pixel information contained within a user defined window 203, which represents a portion of frame 201. An enlarged view of window 203 is shown to the right of frame 201. The enlarged view of window 203 is identified by reference numeral 203X. Window 203X comprises a sixteen by sixteen subarray of the total array of pixels included in frame 201. The subarray as shown in this simplified example includes 256 picture elements organized in a sixteen by sixteen grid. Each pixel is identified by i and j coordinates shown along the left and bottom edges, respectively, of window 203X. Two pixels, P(3,6) and P(6,8) are identified for illustration.

The image contained in window 203, and shown enlarged in window 203X, consists of a section of the pavement of roadway 30. No vehicle appears in the window. This image forms a background or reference to which the next subsequent frame is compared. The vision processor totals the luminance values for P(1,1) through P(16,16) and saves the total sum. The use of this total "reference" value will be explained below.

Figure 3:
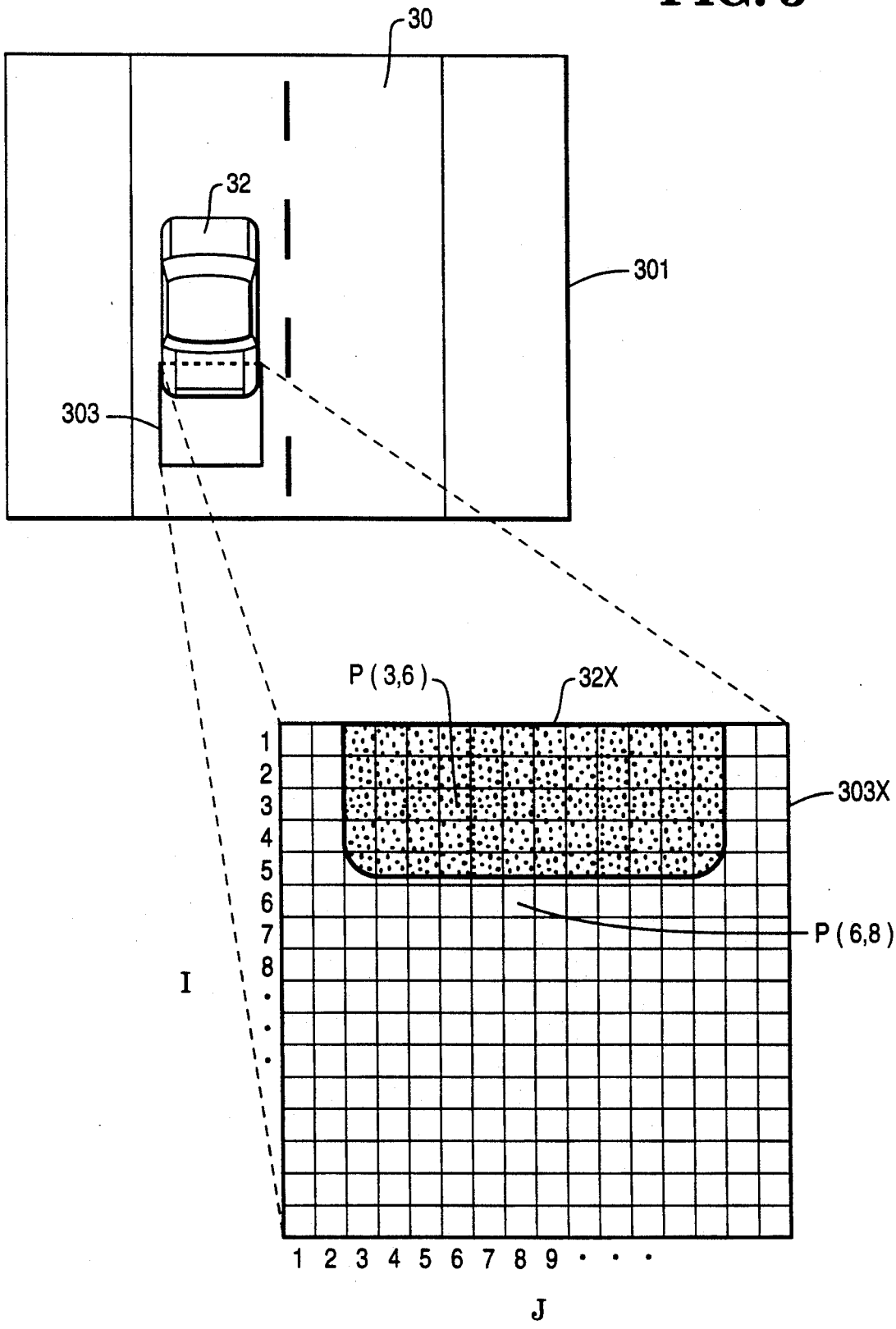
FIG. 3 is an illustration of a second video frame captured by the camera shown in FIG. 1, showing the entry of a vehicle into the rectangular window.

FIG. 3 is an illustration of a second video frame 301, succeeding frame 201 of FIG. 2. Frame 301 presents an image received by camera 10 only a fraction of a second after the image shown in frame 201. The field of view of the camera is unchanged, however vehicle 32 has traveled into the monitored section of the roadway and is now partially contained in window 303, which corresponds to window 203 of FIG. 2. An enlarged view of the image shown in window 303 is illustrated in box 303X. This image is compared to the image shown in 203 in the manner described below to determine the presence of a vehicle at the windowed location of roadway 30.

Vehicle presence is determined by totaling the luminance values of pixels P(1,1) through P(16,16) for window 303X and comparing this total to the reference total calculated from window 203X of FIG. 2. If the difference between the pixel luminance totals for windows 203X and 303X differs by more than a user set threshold value than the vision processor outputs a pulse to indicate that a vehicle has entered the monitored section of roadway 30.

In equation form, a vehicle is detected entering or leaving the monitored section of the roadway whenever:

$$|\Sigma L(i,j,t_2)-\Sigma L(i,j,t_1)|>T_1 \qquad \text{EQN 1}$$

where:

$\Sigma L(i,j,t_1)$ = the summation of the luminance values for pixels associated with the reference window (window 203X) occuring at time $t_1$;

$\Sigma L(i,j,t_2)$ = the summation of the luminance values for pixels associated with a succeeding window occuring at time $t_2$; and $T_1$ = the user set threshold value.

The threshold value $T_1$ is required to allow for minor variations in pixel luminance intensities from frame to frame due to changes in lighting, weather disturbances, or the passage of small objects such as leaves, birds or small animals through the monitored section of the roadway.

After detection of a vehicle, comparisons of pixel luminance totals to the reference total continue in accordance with the following equation:

$$|\Sigma L(i,j,t_2)-\Sigma L(i,j,t_1)|<T_2 \qquad \text{EQN 2}$$

In equation EQN 2, $T_2$ is a second user set threshold value utilized to detect the exit of a detected vehicle from the viewing window. Threshold value $T_2$ must be less than $T_1$. The histogram of FIG. 4 is provided to aid in the understanding of the use of first and second threshold values to determine the entry and exit, respectively, of a vehicle from the viewing window.

Figure 4:
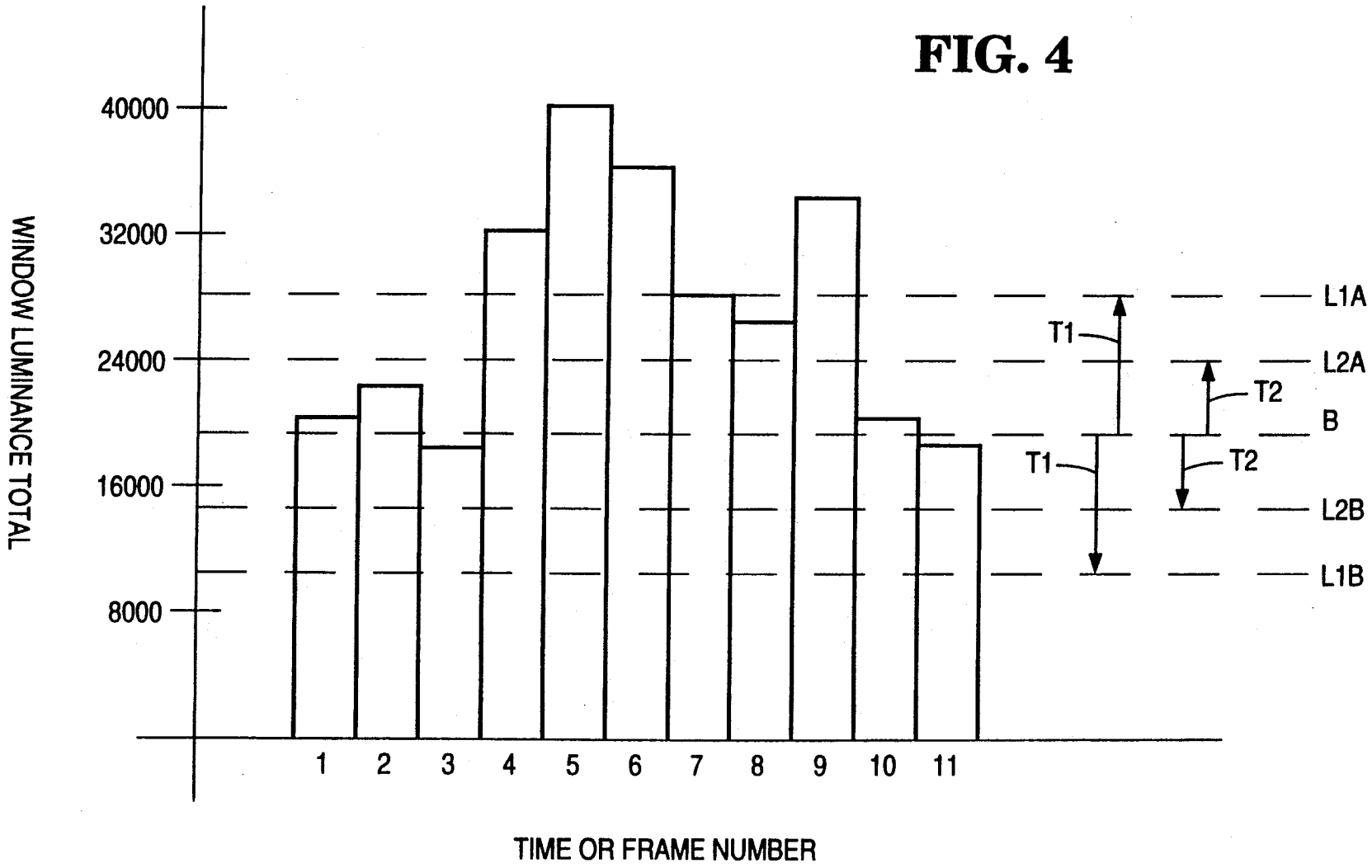
FIG. 4 is a time diagram illustrating the change in luminance characteristics within the rectangular window of FIGS. 2 and 3 over a time period including several successive video frames.

The histogram provided in FIG. 4 shows luminance totals corresponding to ten successive frames occuring at 1/10 second intervals. Frame numbers are provided along the histogram's abscissa while luminance totals are provided along the graph's ordinate. The background value, B, is determined from frame 1. Threshold levels, identified as L1A and L1B, are established above and below the background level B at a distance equivalent to threshold value $T_1$. A signal indicating vehicle detection is generated whenever the frame luminance value exceeds L1A or falls below L1B. In the histogram shown, a signal indicating vehicle presence would be generated from the analysis of frame 4, where the luminance total is first seen to exceed threshold level L1A. Subsequent frame comparisons for the purpose of generating a second signal indicating passage of the vehicle from the monitored area of the roadway, involve the threshold levels identified as L2A and L2B located at a distance equivalent to threshold value $T_2$ above and below background level B, respectively. Thus an "end-of-detection" signal will be generated at frame 10. Frame 7, where the luminance total falls below level L1A but not below L2A is overlooked by the system. The large change in luminance totals between frames 6 and 7, and between frames 7 and 8 could result when a vehicle having two different shapes or two different color surfaces, such as a convertible or a car having a vinyl top, passes through the detection window. The use of this second threshold value, $T_2$, prevents the system from generating a false end-of-detection signal and the subsequent generation of an erroneous second detection signal. Upon the passing of a detected vehicle from the viewing window a new reference luminance total is determined.

It was stated above that the successive frames shown in FIG. 4 occur at 1/10 second intervals. However, a video system operating with a standard scan rate of thirty frames per second generates a new frame every 1/30 of a second. The system described above analyzes every third frame provided by the camera, ignoring the intermediate frames. It has been found that utilizing every third frame, occuring at 1/10th second intervals provides sufficient data for analysis by the system, and also provides ample time between frames to perform the necessary analysis of collected information.

To improve system accuracy, alternative techniques for comparing successive frames to detect vehicle presence are now described. These techniques may be used in substitution for, or in addition to, the method described above where luminance values are totaled and the total compared to a reference value.

Figure 5A:
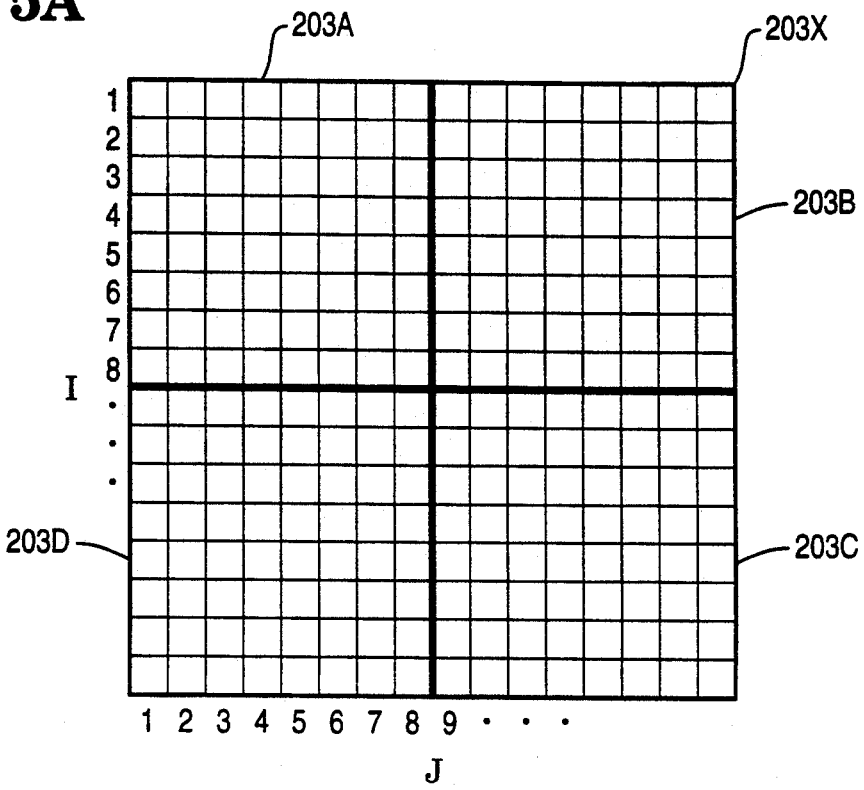
FIGS. 5A and 5B are an illustration of the background window of FIG. 2 and the window of FIG. 3, respectively, divided into quadrants for processing in accordance with an alternative method of the present invention.
Figure 5B:
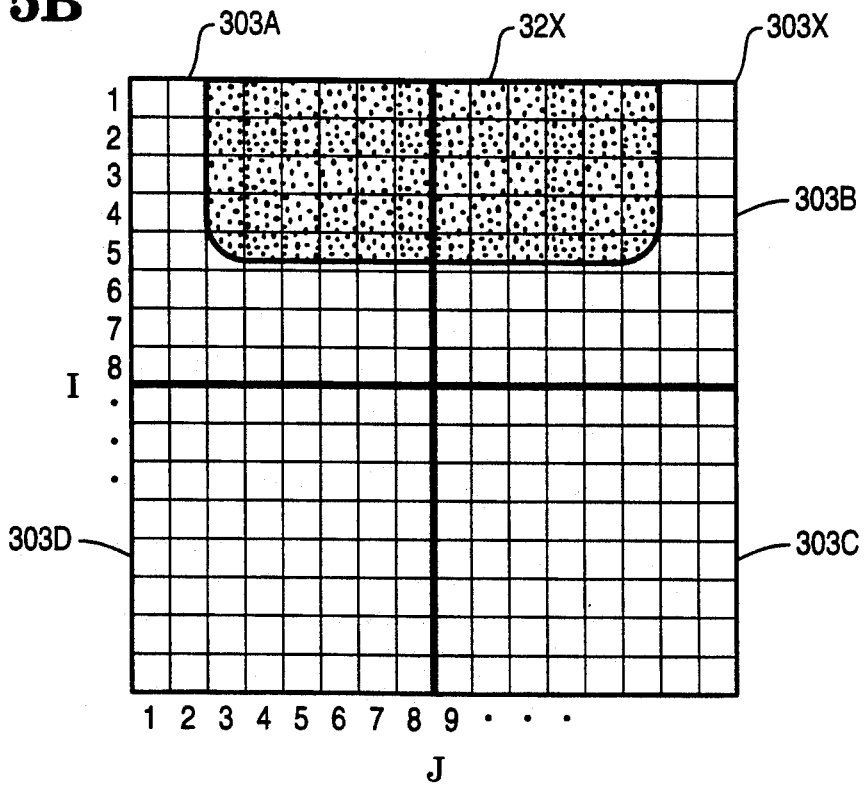

Shown in FIGS. 5A and 5B are background window 203X of FIG. 2 and the corresponding window 303X of FIG. 3, respectively. However, each window has been divided into quadrants labeled 203A through 203D for window 201X, and 301A through 301D for window 301X. For each quadrant of window 203X, the luminance values of the included picture elements are totaled and the total is saved. For example, the luminance values of the pixels identified by i coordinates 1 through 8 and j coordinates 1 through 8 are totaled and the total is saved as the reference value for quadrant 203A, and the luminance values of the pixels identified by i coordinates 1 through 8 and j coordinates 9 through 16 are totaled and the total is saved as the reference value for quadrant 203B. The four background totals corresponding to quadrants 203A through 203D are denoted as $b_{q1}$, $b_{q2}$, $b_{q3}$ and $b_{q4}$, respectively.

For each quadrant of window 303X the luminance values of the included picture elements are similarly totaled and the totals saved. The four totals corresponding to quadrants 303A through 303D are denoted as $x_{q1}$, $x_{q2}$, $x_{q3}$ and $x_{q4}$, respectively. To determine vehicle presence, the root mean square of the difference between the background (203X) and current (303X) windows is calculated as follows:

$$RMS=\sqrt{\sum_{i=1}^{4}(b_{qi}-x_{qi})^2}\ . \qquad \text{EQN 3}$$

This calculated RMS value is compared to user set threshold levels $T_1$ and $T_2$ in the same fashion as discussed above to generate signals indicating the entry and exit of a vehicle from the viewing window. Use of RMS values accentuates the difference between background and succeeding luminance totals.

Figure 6:
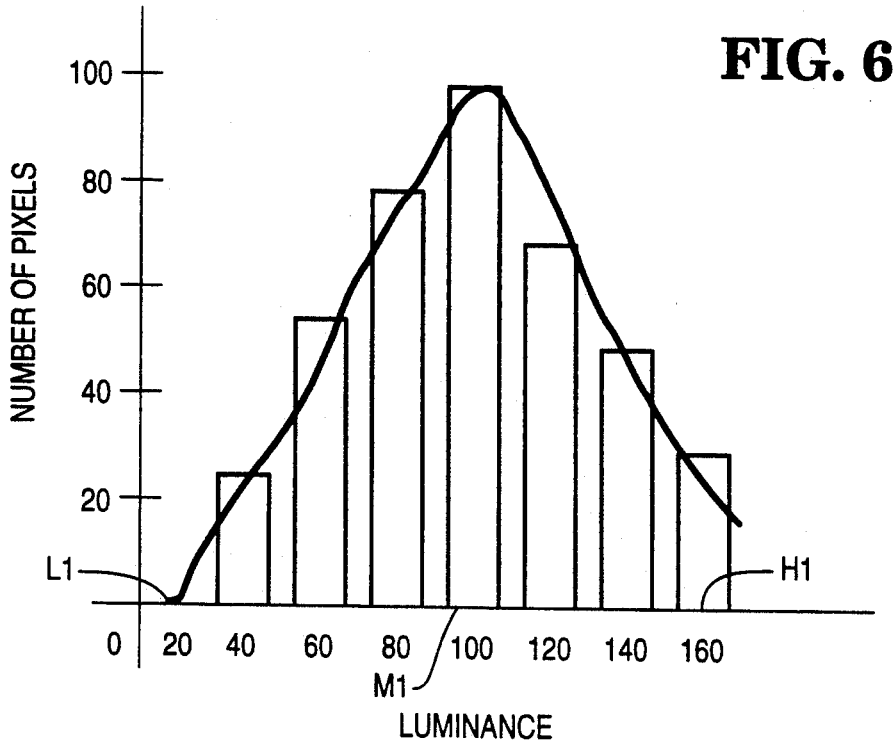
FIGS. 6 and 7 are histograms showing the distribution of pixels by luminance values, for processing in accordance with another method of the present invention.
Figure 7:
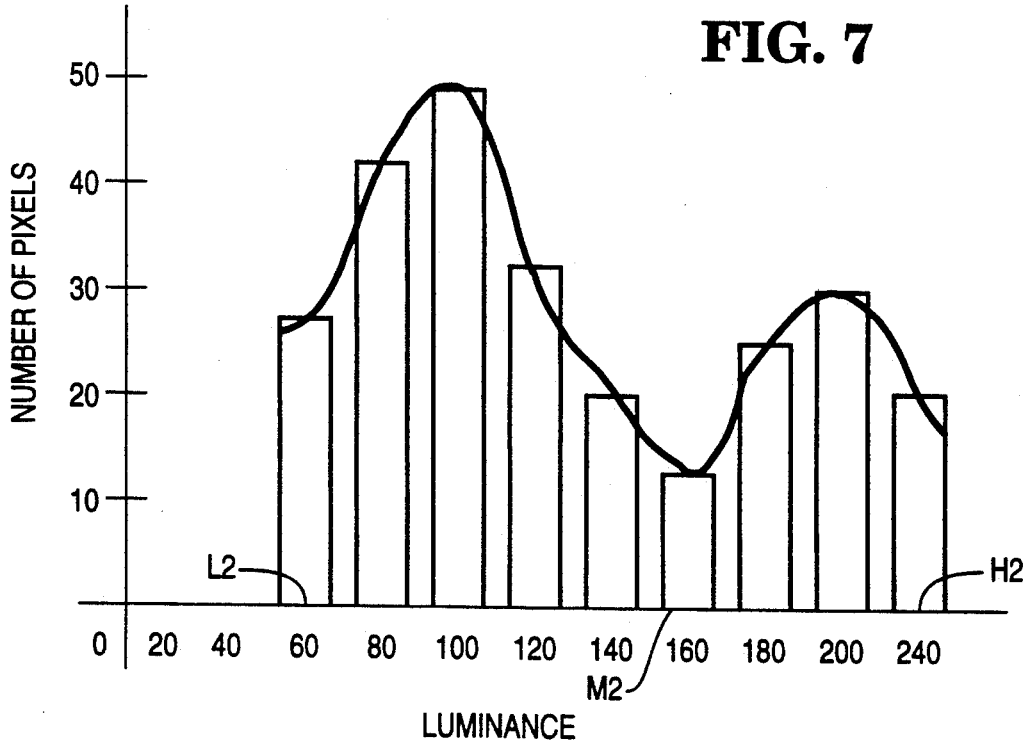

Statistical information gathered from each video frame is utilized to determine vehicle presence in another form of the present invention. The histograms of FIGS. 6 and 7 show the distribution of pixels by luminance values for background window 203X and current window 303X. In the histograms, which have been simplified to explain the present method, pixel counts are displayed for luminance value ranges centered at luminance values of twenty, forty, sixty, eighty, etc.

In FIG. 6, which represents the pixel distribution for the background window 203X, the pixels are distributed in a normal distribution having a mean value of one hundred. The normal distribution would be expected for a view of the nearly uniform surface of the roadway. FIG. 7 represents the pixel distribution for window 303X The histogram shows two local maximums in the pixel distributions centered at luminance values of one hundred and one hundred eighty. The one hundred value represents the average luminance of the roadway while the one hundred eighty value is the mean value of the vehicle. A comparison between the two histograms reveals that the number of pixels associated with the mean luminance value for the roadway is much less in FIG. 7 than in FIG. 8 as the vehicle obstructs a portion of the roadway surface.

By comparing the parameters of the histogram shown in FIGS. 7 with the parameters for the background histogram shown in FIG. 6 the presence of a vehicle in the viewing window can be determined. Possible parameters that may be compared include mean value (M1 and M2), lowest luminance value (L1 and L2), highest luminance value (H1 and H2), mode value and standard deviation.

In addition to the detection of vehicles on the roadway, the system as described above may be utilized to classify detected vehicles by type, to determine spacing between vehicles on the roadway, to calculate vehicle speed and to operate traffic control devices.

Vehicle classification is accomplished by monitoring the amount of time between detection and end-of-detection signals generated for a vehicle. Greater periods of time between these two signals correspond to greater vehicle lengths, assuming uniform vehicle speeds. Periods, or lengths, can be established for such classifications as cars, trucks or tractor-trailer combinations. The determination of spacing between successive vehicles is determined in a similar manner in which the period of time between the receipt of the end-of-detection signal for a first vehicle and the receipt of the detection signal for a second vehicle is monitored.

Figure 8:
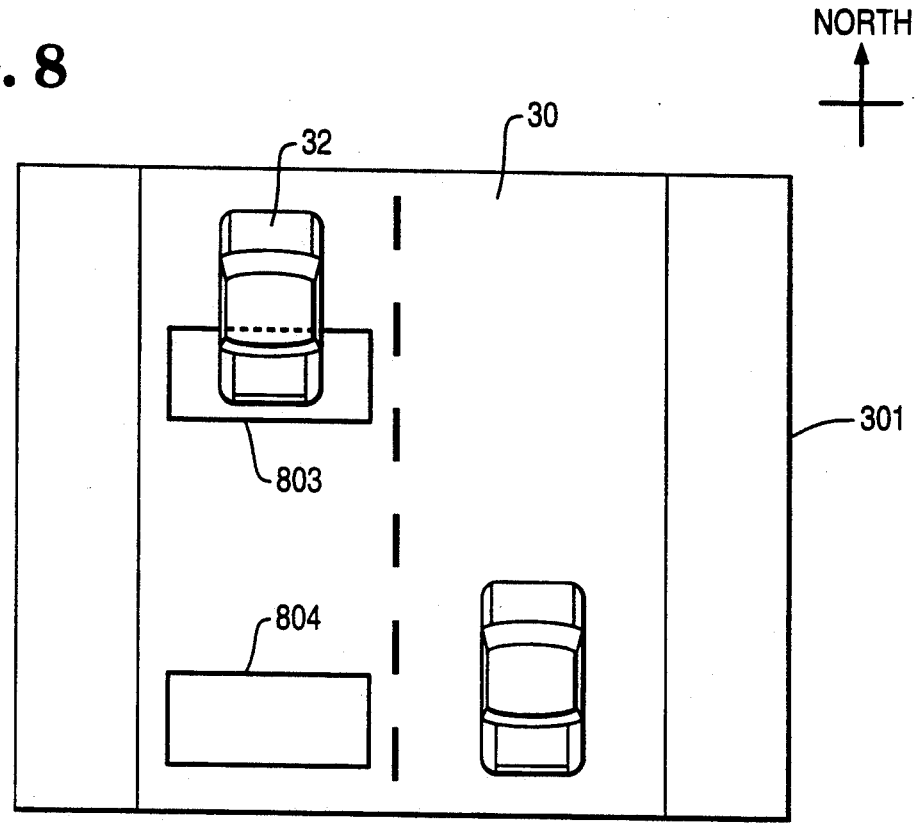
FIG. 8 is an illustration of a video frame captured by the camera shown in FIG. 1 including two rectangular windows which are analyzed by the video system to determine the speed of a vehicle.

Vehicle speeds can be determined by monitoring two portions of the roadway as shown in FIG. 8. Two viewing windows 803 and 804 are shown at different locations along the southbound lane of roadway 30. For each window, detection signals are generated as described above in the discussion of FIGS. 2 through 7. By locating window 804 at a known distance form window 803, and monitoring the amount of time between the generation of the detection signals for the two windows, the average speed of vehicle 32 can be determined from the simple equation: Speed=Distance / Time.

The detection system can be utilized to control traffic signals at intersections in a manner similar to the use of loop detectors to control traffic signals, altering the sequencing and duration of traffic lights upon the detection of a vehicle in a monitored position. However, the ability of the present system to determine vehicle locations, vehicle speeds, vehicle spacing, the number of vehicles passing through a monitored section of roadway, and other traffic parameters enables more precise control over traffic flow. For example, an intersection can be monitored to determine the number of vehicles making left turns, and the result utilized to control the duration of a left turn arrow.

In accordance with another embodiment of the present invention, the system can be constructed to track forward and lateral movement of a vehicle along a roadway, as will now be explained with reference to FIG. 9. Vehicle movement is tracked by analyzing entire video frames rather than a window portion of each frame. For each frame, pixel luminance information is collected and analyzed to differentiate between background surfaces, having a first average pixel luminance value, and vehicle outer surfaces, having a second average pixel luminance value.

One of numerous boundary following algorithms known in the art, such as the eight-connected pixel algorithm, is then employed to identify the coordinates of pixels associated with the vehicle outer surfaces. An equation defining the vehicle surface as a function of x and y coordinates can then be determined from the identified coordinates. The zeroth, first and second "moments" about the vehicle outer surface appearing in the field of view of the camera is then calculated using the mathematical relations presented below to identify the centroid of the vehicle surface.

$$M(n,m) = \int_x \int_y x^n y^m f(x,y)\, dx\, dt \qquad \text{EQN 4}$$

$$M(n,m) = \sum_{x_i=0}^{L} \sum_{y_j=0}^{W} x_i^n y_j^m f(x_i, y_j) \qquad \text{EQN 5}$$

where:

M(n,m)=moment equation for continuous case $\underline{M}$(n,m)=moment equation for discrete case $\overline{f}$(x,y)=function defining the vehicle surface in continuous form $f$(x,y)=function defining the vehicle surface in discrete form L=number of rows of pixels W=number of columns of pixels n+m=the order of moment The surface area and centriod of the vehicle surface are determined from equation EQN 5, the moment equation for the discrete case. The moment equation for the discrete case is utilized to calculate moments since the vehicle surface is represented as a digitized picture. The zeroth moment, which results in calculation of the surface area of the vehicle, is determined by replacing variables n and m with zero, thus yeilding for the discrete case: $\underline{M}(0,0)=\Sigma_x \Sigma_y f(x_i,y_j)$. First order moments produce the x and y coordinates of the centroid of the surface. The first order moments are determined by replacing n with one and m with zero to determine the x coordinate of the centroid, and n with zero and m with one to determine the y coordinate of the centroid. The resulting moment equations for x and y would be $\underline{M}(1,0)=\Sigma_x \Sigma_y x\ f(x_i,y_j)$ and $\underline{M}(0,1)=\Sigma_x \Sigma_y y\ f(x_i,y_j)$, respectively.

Also, when the vehicle first appears in the field of view of the camera a timer is started which is synchronized with the recording of the video frames. Thereafter, the x and y coordinates of the vehicle centroid and the elapsed time are calculated, continuously updated, and recorded by the vision system. From the calculated information vehicle position (x,y); x and y components of speed, dx/dt and dy/dt, respectively; and x and y components of acceleration, $d^2x/dt$ and $d^2y/dt$, respectively, can be easily calculated.

Figure 9:
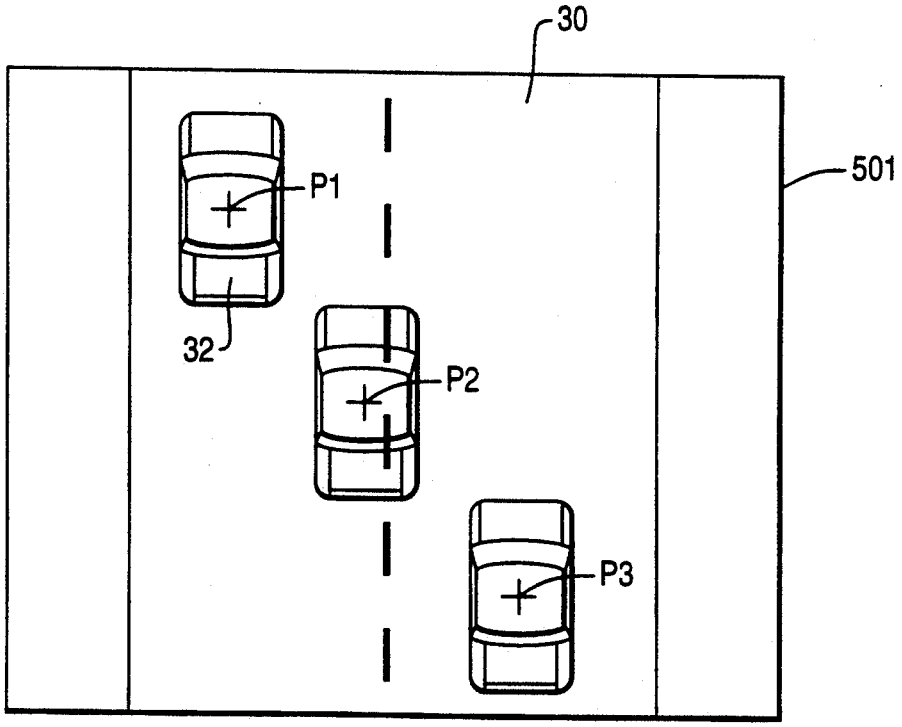
FIG. 9 is an illustration of a video frame captured by the camera which is analyzed by the video system to track movement of a vehicle along a roadway in accordance with another embodiment of the present invention.

FIG. 9 shows the vehicle 32 at three positions along roadway 30. The vehicle centriods are identified by reference numerals P1, P2 and P3. Coordinates $(x_1, y_1)$, $(x_2, y_2)$ and $(x_3, y_3)$ and times $t_1$, $t_2$ and $t_3$ are associated with centriods P1, P2 and P3. The forward and lateral speeds of vehicle 32 between points P1 and P2 can be determined from the equations $v_x=(x_2-x_1)/(t_2-t_1)$ and $v_y=(y_2-y_1)/(t_2-t_1)$, respectively. Forward acceleration between points P1 and P3 can be determined by analyzing velocity changes between points P1 and P3.

The preceding discussion disclosed a new and useful system and several methods for monitoring traffic flow. In addition, procedures for analyzing collected traffic information were presented. Those skilled in the art will recognize that the invention is not limited to the specific embodiments described and illustrated and that numerous modifications and changes are possible without departing from the scope of the present invention. For example, various resolution cameras can be utilized within the system. Viewing windows can be enlarged to contain more pixels than shown in FIGS. 2, 3 and 5. Also the system can be modified to analyze infrared or X-ray images rather than visible light images.

It is also possible to multiplex together video signals received from two or more cameras for analysis by the vision computer. For example, four cameras can be utilized to monitor the four roadways entering an intersection. The four resulting images can then be multiplexed together to form a composite image, each one of the roadways being shown in a seperate quadrant of the composite image. Four viewing windows associated with the four roadways shown in the composite image can be established to collect information for analysis by the video system.

These and other variations, changes, substitutions and equivalents will be readily apparent to those skilled in the art without departing from the spirit and scope of the present invention. Accordingly, it is intended that the invention to be secured by Letters Patent be limited only by the scope of the appended claims.

What is claimed is:

1. A method for determining the speed of a vehicle traveling along a predetermined path, comprising the steps of:

generating a reference image of a section of said path;

transducing said reference image into a reference array of pixels;

generating successive images of said section of said path;

transducing said successive images into successive arrays of pixels;

separating each one of said arrays of pixels into first and second subarrays of pixels, each of said subarrays corresponding to first and second portions of said path, said first and second portions of said path being separated by a known distance;

summing the intensity values of all the pixels in said first subarray of said reference array;

summing the intensity values of all the pixels in said first subarray of each one of said successive arrays;

successively comparing the pixel intensity sum for each said first subarray of each one of said successive arrays to the pixel intensity sum for said first subarray of said reference array;

generating data indicative of the presence of said vehicle in said first portion of said path when the difference in pixel intensity sums between said first subarrays recited in said comparing step exceeds a predetermined value;

recording a first reference time when said vehicle is first determined to be present in said first portion of said path;

summing the intensity values of all the pixels in said second subarray of said reference array;

summing the intensity values of all the pixels in said second subarray of each one of said successive arrays;

successively comparing the pixel intensity sum for each said second subarray of each one of said successive arrays to the pixel intensity sum for said second subarray of said reference array;

generating data indicative of the presence of said vehicle in said second portion of said path when the difference in pixel intensity between said second subarrays recited in said last-recited comparing step exceeds said predetermined value;

recording a second reference time when said vehicle is first determined to be present in said second portion of said path; and calculating the speed of said vehicle from the difference in said first and second reference times and said known distance between said first and second portions of said path.

2. A method for determining the interval between first and second vehicles traveling along a predetermined path, comprising the steps of:

generating a reference image of a section of said path;

transducing said reference image into a reference array of pixels;

generating successive images of said section of said path;

transducing said successive images into successive arrays of pixels;

successively comparing pixel intensity information obtained from each one of said successive arrays to pixel intensity information obtained from said reference array;

generating data indicative of the presence of said first vehicle in said section of said path when the difference in pixel intensity information between one of said successive arrays and said reference array exceeds a predetermined value;

recording a first reference time when said first vehicle is determined to be present in said section of said path;

generating data indicative of the presence of said second vehicle in said section of said path when the difference in pixel intensity information between a second one of said successive arrays and said reference array exceeds said predetermined value;

recording a second reference time when said second vehicle is determined to be present in said section of said path; and calculating the interval between said first and second vehicles from the difference in said first and second reference times.

3. A method for determining the length of a vehicle traveling along a predetermined path, comprising the steps of:

generating a first reference image of a first section of said path;

transducing said first reference image into a first reference array of pixels;

generating first successive images of said first section of said path;

transducing said successive images into first successive arrays of pixels;

successively comparing pixel intensity information obtained from each one of said first successive arrays to pixel intensity information obtained from said first reference array;

generating data indicative of the presence of said vehicle in said first section of said path when the difference in pixel intensity information between one of said first successive arrays and said first reference array exceeds a first predetermined value;

recording a first reference time when said vehicle is determined to be present in said first section of said path;

generating data indicating that said vehicle has vacated said first section of said path when the difference in pixel intensity information between one of said first successive arrays and said first reference array falls below a second predetermined value;

recording a second reference time when said vehicle is determined to have vacated said first section of said path;

determining the difference between said first and second reference times;

determining the speed of said vehicle; and determining the length of said vehicle by multiplying said time difference by the speed of said vehicle.

4. The method according to claim 3, wherein the step of determining the speed of said vehicle comprises the steps of:

generating a second reference image of a second section of said path, said first and second sections being separated by a known distance;

transducing said second reference image into a second reference array of pixels;

generating second successive images of said second section of said path;

transducing said second successive images of said second section of said path into second successive arrays of pixels;

successively comparing pixel intensity information obtained from said second successive arrays to pixel intensity information obtained from said second reference array;

generating data indicative of the presence of said vehicle in said second section of said path when the difference in pixel intensity information between one of said second successive arrays and said second reference array exceeds said first predetermined value;

recording a third reference time when said vehicle is first determined to be present in said second section of said path;

determining the speed of said vehicle from the difference in said first and third reference times and said known distance between said first and second sections of said path.

5. The method according to claim 3, further comprising the step of classifying vehicle types by length.

6. A method for tracking the movement of a vehicle within the field of view of a video camera, comprising the steps of:

generating successive images of said field of view;

transducing said successive images into successive arrays of pixels;

identifying the coordinates of pixels associated with the image of said vehicle for each of said successive arrays;

electronically determining the centroid of the image of said vehicle from said coordinates; and recording the coordinates of said centroid for each of said successive arrays.

7. The method according to claim 6, further comprising the step of recording time of occurrence together with the coordinates of said centroid for each of said arrays.

8. The method according to claim 7, further comprising the step of determining vehicle velocity from said recorded coordinate and time data.

9. The method according to claim 7, further comprising the step of determining vehicle acceleration from said recorded coordinate and time data.

* * * * *